US010559410B2

(12) United States Patent
Okabe et al.

(10) Patent No.: US 10,559,410 B2
(45) Date of Patent: Feb. 11, 2020

(54) GRAIN-ORIENTED ELECTRICAL STEEL SHEET AND TRANSFORMER IRON CORE USING SAME

(71) Applicant: JFE STEEL CORPORATION, Tokyo (JP)

(72) Inventors: Seiji Okabe, Tokyo (JP); Hirotaka Inoue, Tokyo (JP); Shigehiro Takajo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 20 days.

(21) Appl. No.: 14/894,697

(22) PCT Filed: May 27, 2014

(86) PCT No.: PCT/JP2014/002804
§ 371 (c)(1),
(2) Date: Nov. 30, 2015

(87) PCT Pub. No.: WO2014/203464
PCT Pub. Date: Dec. 24, 2014

(65) Prior Publication Data

US 2016/0133368 A1 May 12, 2016

(30) Foreign Application Priority Data

Jun. 19, 2013 (JP) ..... 2013-128825

(51) Int. Cl.
*H01F 1/01* (2006.01)
*H01F 41/02* (2006.01)
(Continued)

(52) U.S. Cl.
CPC ..... *H01F 3/02* (2013.01); *C21D 8/125* (2013.01); *C21D 8/1277* (2013.01);
(Continued)

(58) Field of Classification Search
None
See application file for complete search history.

(56) References Cited

U.S. PATENT DOCUMENTS 4,293,350 A 10/1981 Ichiyama et al.
5,146,063 A 9/1992 Inokuti
(Continued)

FOREIGN PATENT DOCUMENTS

CN 103069035 A 4/2013
EP 1 227 163 A2 7/2002
(Continued)

OTHER PUBLICATIONS

Sep. 2, 2014 International Search Report issued in International Patent Application No. PCT/JP2014/002804.
(Continued)

*Primary Examiner* — Xiaowei Su
(74) *Attorney, Agent, or Firm* — Oliff PLC

(57) ABSTRACT

A grain-oriented electrical steel sheet subjected to magnetic domain refining by linearly introducing strains in a direction intersecting a rolling direction of the steel sheet repeatedly with intervals in the rolling direction, wherein if a repeating interval of the strains in the rolling direction is d (mm) and, when the steel sheet is placed on a flat surface, a mean value of difference between a height from the flat surface in linear strain-introduced areas of a steel sheet surface and a height from the flat surface in intermediate points between adjacent linear strain-introduced areas is h (mm), then the ratio h/d of the h to the d is 0.0025 or more and 0.015 or less.

8 Claims, 1 Drawing Sheet

(51) Int. Cl.

| | |
|---|---|
| ***C21D 8/12*** | (2006.01) |
| ***H01F 3/02*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***H01F 1/16*** | (2006.01) |
| ***C22C 38/18*** | (2006.01) |
| ***H01F 27/245*** | (2006.01) |

(52) U.S. Cl.
CPC ..... *C21D 8/1288* (2013.01); *C22C 38/00* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/18* (2013.01); *C22C 38/60* (2013.01); *H01F 1/16* (2013.01); *H01F 27/245* (2013.01)

(56) References Cited

U.S. PATENT DOCUMENTS

| | | | | |
|---|---|---|---|---|
| 2013/0098507 | A1 | 4/2013 | Omura et al. | |
| 2013/0130043 | A1* | 5/2013 | Omura ..... | C21D 8/1255 428/450 |
| 2013/0143003 | A1 | 6/2013 | Takenaka et al. | |
| 2013/0143050 | A1 | 6/2013 | Omura et al. | |
| 2013/0206283 | A1* | 8/2013 | Inoue ..... | C21D 1/38 148/108 |

FOREIGN PATENT DOCUMENTS

| | | | | |
|---|---|---|---|---|
| EP | 2 602 339 | A1 | 6/2013 | |
| JP | H02-277780 | A | 11/1990 | |
| JP | H06-72266 | B2 | 9/1994 | |
| JP | 2012-036445 | A | 2/2012 | |
| JP | WO 2012017655 | A1 * | 2/2012 | ..... C21D 8/1255 |
| JP | WO 2012017693 | A1 * | 2/2012 | ..... C21D 1/38 |
| JP | 2012-052228 | A | 3/2012 | |

OTHER PUBLICATIONS

Nov. 18, 2014 Decision to Grant a Patent issued in Japanese Patent Application No. 2013-128825.
May 10, 2016 Extended European Search Report issued in European Patent Application No. 14814563.4.
Jun. 23, 2016 Office Action issued in Chinese Patent Application No. 201480034559.4.
Dec. 8, 2016 Office Action issued in Chinese Patent Application No. 201480034559.4.
Aug. 7, 2017 Office Action issued in Chinese Patent Application No. 201480034559.4.
Apr. 19, 2017 Office Action issued in Chinese Patent Application No. 201480034559.4.
Aug. 14, 2018 Office Action issued in Chinese Patent Application No. 201480034559.4.

* cited by examiner

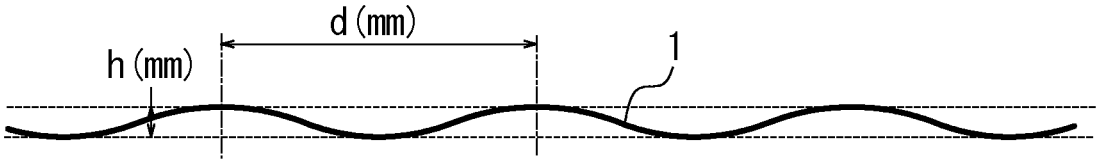
d (mm)
h (mm)
1

GRAIN-ORIENTED ELECTRICAL STEEL SHEET AND TRANSFORMER IRON CORE USING SAME

TECHNICAL FIELD

This disclosure relates to a grain-oriented electrical steel sheet with low iron loss which is suitable for use in an iron core material of a transformer or the like, and particularly to a grain-oriented electrical steel sheet subjected to magnetic domain refining.

BACKGROUND

A grain-oriented electrical steel sheet is mainly utilized as an iron core material of a transformer or the like, and is required to have excellent magnetization characteristics, in particular low iron loss. In this regard, it is important to highly accord secondary recrystallized grains of the steel sheet with the (110)[001] orientation (or so-called Goss orientation) and to minimize impurities and precipitates present in steel of finished products. However, there are limitations in controlling crystal orientation and reducing impurities and precipitates in terms of balancing with manufacturing cost, and so on. Accordingly, there has been developed a technique of introducing non-uniformity into a surface of a steel sheet by physical means to subdivide width of magnetic domains to reduce iron loss, i.e. a magnetic domain refining technique.

For example, PTL 1 (JPS57002252B) and PTL2 (JPH0672266B) disclose a technique of irradiating a surface of a finished product steel sheet with a laser beam or an electron beam in a direction substantially orthogonal to the rolling direction with intervals of several millimeters, to introduce linear high-dislocation density regions (strains) into a surface layer of the steel sheet, thereby narrowing magnetic domain widths and reducing iron loss.

While the strains subdivide width of magnetic domains to reduce iron loss, they cause local deformation in steel sheets. Generally, since strains for magnetic domain refining are introduced in one side of the steel sheet, a deflection where the strain-introduced surface becomes the inner side inevitably occurs. Conventionally, this deflection was considered to deteriorate characteristics of the grain-oriented electrical steel sheet such as iron loss properties and magnetostrictive properties, and techniques for limiting the area of deflection have been disclosed. For example, PTL3 (JP2012052228A) discloses a grain-oriented electrical steel sheet with reduced iron loss, obtained by satisfying a predetermined relation between the tension-applying insulating coating and the tension applied to the steel sheet surface before strain-introducing treatment, and limiting the magnitude of deflection of the steel sheet per length of 280 mm of a strain-introduced surface side after strain-introducing treatment, to 1 mm or more and 10 mm or less, in particular 3 mm or more and 8 mm or less.

Here, the magnitude of deflection if the steel sheet depends on irradiation conditions such as laser beam or electron beam at the time of introducing strains. Beam power, beam scanning rate, beam spot shape, and irradiation interval are conditions which have a particularly great influence.

CITATION LIST

Patent Literature

PTL 1: JPS57002252B
PTL 2: JPH06072266B
PTL 3: JP2012052228A

As described above, conventionally, under the assumption that the deflection in the steel sheet subjected to magnetic domain refining has a large influence on characteristics of the grain-oriented electrical steel sheet, the degree of said deflection was limited to achieve certain results. However, when producing a transformer iron core using a steel sheet following such limitation, there were cases where the produced transformers exhibited different iron loss properties, even though they were produced using steel sheets limited to equivalent iron loss properties and an equivalent degree of deflection. Particularly, the fact that iron loss properties expected from the material steel sheets were not achieved in transformers has been a technical problem in grain-oriented electrical steel sheets subjected to magnetic domain refining.

It could therefore be helpful to provide a grain-oriented electrical steel sheet that can further reduce the iron loss of a transformer, and as a result, contribute to enhancing efficiency of the transformer.

SUMMARY

We closely examined the reason for the difference caused in iron loss properties between transformers despite the fact that the steel sheets used as the iron core material have equivalent iron loss properties and an equivalent degree of deflection, and the transformers are produced using said steel sheets. As a result, we discovered that, rather than the degree of deflection of the steel sheet created by magnetic domain refining, the shape in the vicinity of strain introduced areas of the steel sheet has an influence on iron loss properties of the transformer. This is believed to be because of the following reasons.

When producing an iron core, grain-oriented electrical steel sheets are stacked in the form of an iron core, and then pressed with structural steel sheets or the like. Therefore, even if grain-oriented electrical steel sheets are deflected as iron core material, they are corrected to be flat in the resulting iron core. Conventionally, attempts have been made to limit deflection based on the technical concept that a smaller deformation at the time of correction results in a smaller stress applied at the time of correction and therefore magnetic properties are not deteriorated. However, in reality, since the strain introduced areas are much of the cause of the deflection of a steel sheet, the stress generated by the correction of the deflection is not uniformly applied on the steel sheet. Further, since tensile stress is applied to the inner side of a portion of the steel sheet where the deflection of the steel sheet has been corrected, the effect of enhancing the magnetic domain refining effect is also produced. As a result of investigating the shape of the steel sheet subjected to magnetic domain refining in further detail, it was revealed that even if the steel sheet is placed on a flat surface and the deflection is corrected by the steel sheet's own weight, the deformation remaining in the steel sheet affects the iron loss value particularly in the transformer. As a result of intense investigations regarding the conditions of the steel sheet shape, the disclosure has been completed.

The disclosure is based on the aforementioned discoveries. We thus provide the following.

(1) A grain-oriented electrical steel sheet subjected to magnetic domain refining by linearly introducing strains in a direction intersecting a rolling direction of the steel sheet repeatedly with intervals in the rolling direction, wherein if a repeating interval of the strains in the rolling direction is d (mm) and, when the steel sheet is placed on a flat surface, a mean value of difference between a height from the flat surface in linear strain-introduced areas of a steel sheet surface and a height from the flat surface in intermediate points between adjacent linear strain-introduced areas is h (mm), then the ratio h/d of the h to the d is 0.0025 or more and 0.015 or less.

(2) The grain-oriented electrical steel sheet according to aspect (1), wherein the d is 3 mm or more and 6 mm or less.

(3) The grain-oriented electrical steel sheet according to aspect (1) or (2), wherein the strain is formed by electron beam irradiation.

(4) A transformer iron core using the grain-oriented electrical steel sheet according to any one of aspects (1) to (3).

Advantageous Effect

By forming a grain-oriented electrical steel sheet subjected to magnetic domain refining by introducing strains into an appropriate shape for being placed on a flat surface in accordance with the disclosure, iron loss of the resulting transformer can surely be reduced.

BRIEF DESCRIPTION OF THE DRAWINGS

In the accompanying drawing:

FIG. 1 is a schematic diagram showing the steel sheet shape in the vicinity of the strain introduced area of the grain-oriented electrical steel sheet described herein.

DETAILED DESCRIPTION

The following describes the disclosure in detail with reference to FIG. 1. In the disclosure, the shape of a grain-oriented electrical steel sheet subjected to magnetic domain refining by introducing strains is appropriately controlled in the state where the steel sheet is placed on a flat surface. As described above, by repeatedly introducing, in a rolling direction of a grain-oriented electrical steel sheet, linear strains which are linear strain introduced areas (hereinafter referred to simply as "strain lines"), in a direction intersecting the rolling direction, the grain-oriented electrical steel sheet is subjected to magnetic domain refining and undergoes deflection such that the surface on the strain-introduced side becomes the inner side. When the grain-oriented electrical steel sheet deflected due to the introduction of strain lines is placed on a flat surface with the strain-introduced surface facing the flat surface, the deflection of the steel sheet against the flat surface is corrected under its own weight. However, in the vicinity of strain-line introduced areas, wave-shaped portions with the strain lines being peaks remain in the steel sheet (FIG. 1).

In this regard, since the shape of the steel sheet is affected by the repeating interval of strains in the rolling direction and the magnitude of strains introduced in the vicinity of the strain lines, the steel sheet does not necessarily have the same shape when placed on the flat surface even if the deflection of the steel sheet before placed on the flat surface is the same. Further, when producing an iron core, the steel sheet is pressed with structural steel sheets or the like, or fastened with glass tapes or the like, and corrected into flat shapes. However, even in such case, waver-shaped portions remain, and as the steel sheet does not become completely flat, slight gaps are generated between steel sheets. Since the gaps decrease the stacking factor of the iron core and increase the substantial magnetic flux density of the transformer during magnetization, deterioration of iron loss properties is caused in the transformer.

On the other hand, when the deflected steel sheet is corrected to be flat during production of iron cores or the like, tensile stress is caused in the inner side of the deflection, and therefore the magnetic domain refining effect is enhanced. Unlike the inner side surface of the deflection where plastic strain is formed in the surface by irradiation of laser beam or electron beam, in the outer side surface of the deflection, compressive stress is generated but said stress is not concentrated in a certain area. Therefore, unless the deflection is excessive, the influence of stress on deterioration of magnetic properties is small. In other words, depending on the stress generated when correcting the steel sheet, the deflection of the steel sheet caused by strains has an advantageous effect on iron loss properties.

Even if the heights of the wave forms of when the steel sheets are placed on a flat surface are the same, when the repeating interval of strains in the rolling direction is wide, it is easier to correct the deflection by fastening. Further, since the above mentioned stress concentration is small, magnetic properties are less deteriorated. The deterioration of magnetic properties when producing transformers is more affected by the heights of the wave forms of when the steel sheets are placed on the flat surface and the repeating interval of strains in the rolling direction, than the influence of the deflection of the steel sheet.

As shown in FIG. 1, the repeating interval of the linear strains introduced in the surface of the steel sheet 1 in the rolling direction is defined as d (mm) and, when the steel sheet 1 is placed on a flat surface, the mean value of difference between a height from the flat surface in linear strain-introduced areas of a surface of the steel sheet 1 and a height from the flat surface in intermediate points between adjacent linear strain-introduced areas (hereinafter, simply referred to as "difference in height") is referred to as h (mm).

As a result of our investigation, it was revealed that when the ratio h/d of the mean value h (mm) of the difference in height to the repeating interval d (mm) of the strains in the rolling direction is 0.0025 or more and 0.015 or less, the iron loss of the transformer produced using the steel sheet can further be reduced. If the ratio h/d is less than 0.0025, the tension generated between strain lines is small, and therefore the magnetic domain refining effect decreases and iron loss increases. Further, if the ratio h/d exceeds 0.015, the stacking factor of the iron core decreases, and the compressive stress introduced to the steel sheet during fastening when producing iron cores becomes excessive, and iron loss increases in such case as well.

When performing laser irradiation or electron beam irradiation for reducing iron loss by magnetic domain refining, even if one of the parameters such as the repeating interval of strains in the rolling direction, beam intensity, beam spot shape, and beam scanning rate is changed, the iron loss values of the steel sheet may be kept nearly the same by adjusting the other parameters. However, even if the iron loss values of the steel sheets are nearly the same, if the strain lines are introduced in a different manner, the wave shapes of when the steel sheets are placed on a flat surface would be different. For example, if the beam intensity is large, if the beam spot is small, or if the beam scanning rate is high, the plastic strain introduced into the steel sheet is introduced into the surface layer in a high density, and therefore when producing a transformer, the stress generated when correcting the steel sheet to be flat easily concentrates in the vicinity of strain lines and the above mentioned mean value h of the difference in height becomes large.

Therefore, in order to set the ratio h/d to 0.0025 or more and 0.015 or less, the beam intensity (laser beam output, beam current of electron beam, accelerating voltage), beam spot shape (focal diameter, defocus amount), and the beam scanning rate must be selected as appropriate. The ratio h/d can be made to fall within the range of 0.0025 to 0.015 by, for example, adjusting irradiation conditions as appropriate, under irradiation conditions of output: 10 W to 1000 W, beam spot diameter: 0.01 mm to 0.5 mm, scanning rate: 1 m/s to 100 m/s when introducing strain lines with a laser beam, and under irradiation conditions of accelerating voltage: 10 kV to 200 kV, beam current: 1 mA to 50 mA, beam spot diameter: 0.01 mm to 0.5 mm, scanning rate: 1 m/s to 100 m/s when introducing strain lines with an electron beam. The above irradiation conditions are not intended to limit the disclosure.

When the ratio h/d is in the above range, while the tolerable mean value h of the difference in height is limited by the repeating interval d of strains in the rolling direction, d is preferably 3 mm or more and 6 mm or less. By doing so, iron loss of the steel sheet (iron loss of the transformer) can be reduced without making the ratio h/d excessively large.

Further, although strains may be introduced either by laser beam irradiation or electron beam irradiation, they are preferably introduced by electron beam irradiation. This is because when comparing laser beam irradiation and electron beam irradiation, electron beams transmit through the insulating coating of the steel sheet surface and generates heat after transmitting the steel sheet surface for several μm to 10 μm or so, the damage in the insulating coating is small. Further, this is also due to the fact that, with electron beam irradiation, strains introduced into the steel sheet are not concentrated in the steel sheet surface and are distributed inside the steel sheet, and therefore the stress concentration when correcting the steel sheet to be flat is mitigated.

In the disclosure, "linear" includes not only solid straight lines but also linear lines in the form of solid lines, dashed lines, dotted lines and the like. When the laser irradiation or the electron beam irradiation for introducing strains is discontinuous rather than continuously linear, the mean value of the area affected by irradiation is used as the affected area. Further, in the disclosure, the "direction intersecting a rolling direction" stands for an angle range of within ±30° to the direction orthogonal to the rolling direction.

Next, the chemical composition and conditions for producing a grain-oriented electrical steel sheet described herein will be specifically described below. In the disclosure, as long as secondary recrystallization with good orientation is caused, the chemical composition of the slab for the grain-oriented electrical steel sheet is not particularly limited.

Further, in order to cause secondary recrystallization, the chemical composition may contain appropriate amounts of Al and N in the case where an inhibitor, e.g. an AlN-based inhibitor, is used or appropriate amounts of Mn and Se and/or S in the case where an MnS.MnSe-based inhibitor is used. Of course, both inhibitors may also be used in combination. When the inhibitors are used, contents of Al, N, S and Se are preferably Al: 0.01 mass % to 0.065 mass %, N: 0.005 mass % to 0.012 mass %, S: 0.005 mass % to 0.03 mass %, and Se: 0.005 mass % to 0.03 mass %, respectively.

Further, the disclosure can also be applied to a grain-oriented electrical steel sheet where the contents of Al, N, S, and Se are limited and no inhibitor is used. In such case, the contents of Al, N, S and Se are preferably limited to Al: 100 mass ppm or less, N: 50 mass ppm or less, S: 50 mass ppm or less, and Se: 50 mass ppm or less, respectively.

In detail, the basic components and optional components of the slab for a grain-oriented electrical steel sheet described herein are as follows.

C: 0.08 mass % or less

C is added to improve the structure of the hot rolled sheet. However, if the content thereof exceeds 0.08 mass %, it is difficult to reduce C content during the manufacturing process to 50 mass ppm or less where magnetic aging does not occur. Therefore, C content is preferably 0.08 mass % or less. There is no need to particularly set the lower limit of C content because secondary recrystallization can be caused even with a material not containing C.

Si: 2.0 mass % to 8.0 mass %

Si is an element which effectively increases electrical resistance of steel to improve iron loss properties thereof. However, if the content thereof is less than 2.0 mass %, a sufficient effect of reducing iron loss is not achieved. On the other hand, if Si content exceeds 8.0 mass %, formability significantly deteriorates and magnetic flux density decreases as well. Therefore, Si content is preferably in the range of 2.0 mass % to 8.0 mass %.

Mn: 0.005 mass % to 1.0 mass %

Mn is an element which is necessary for improving hot workability.

However, if the content thereof is less than 0.005 mass %, the addition effect is limited. On the other hand, if Mn content exceeds 1.0 mass %, the magnetic flux density of the product steel sheet decreases. Therefore, Mn content is preferably in the range of 0.005 mass % to 1.0 mass %. In addition to the above basic components, the following elements may be contained as appropriate, as elements for improving magnetic properties.

At least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Cr: 0.03 mass % to 1.50 mass %, and Mo: 0.005 mass % to 0.10 mass %

Ni is a useful element which improves the structure of the hot rolled sheet to enhance magnetic properties. However, if Ni content is less than 0.03 mass %, it is less effective for improving magnetic properties. On the other hand, if it exceeds 1.50 mass %, secondary recrystallization becomes unstable and magnetic properties deteriorate. Therefore, Ni content is preferably in the range of 0.03 mass % to 1.50 mass %.

Further, Sn, Sb, Cu, P, Cr, and Mo are each useful elements in terms of improving magnetic properties. However, if the contents of these elements are lower than the respective lower limits described above, the magnetic properties-improving effect is limited. On the other hand, if the contents of these elements exceed the respective upper limits described above, the growth of secondary recrystallized grains is inhibited. Therefore, the elements are preferably contained within their respective ranges described above.

The balance other than the above-described elements includes Fe and incidental impurities that are incorporated during the manufacturing process.

Next, the steel slab having the above described chemical composition is subjected to heating and subsequent hot rolling in a conventional manner. Here, the slab may also be subjected to hot rolling directly after casting, without heating. In the case of a thin slab or thinner cast steel, it may be subjected to hot rolling or directly proceed to the subsequent step, omitting hot rolling.

Further, hot band annealing is performed as necessary. When performing hot band annealing, in order to highly develop the Goss texture in the product steel sheet, the hot band annealing temperature is preferably in a range of 800° C. to 1100° C. If the hot band annealing temperature is lower than 800° C., there remains a band texture resulting from hot rolling, which makes it difficult to obtain a primary recrystallized texture of uniformly-sized grains and inhibits the growth of secondary recrystallization. On the other hand, if the hot band annealing temperature exceeds 1100° C., the grain size after hot band annealing coarsens excessively, which makes it extremely difficult to obtain a primary recrystallization texture of uniformly-sized grains.

After the hot band annealing, the steel sheet is subjected to cold rolling once, or twice or more with intermediate annealing performed therebetween, followed by primary recrystallization annealing and application of an annealing separator. After the application of the annealing separator, the steel sheet is subjected to final annealing for purposes of secondary recrystallization and formation of a forsterite film.

After final annealing, flattening annealing is performed to correct the shape of the steel sheet. When performing flattening annealing, it is effective to apply tension coating on the steel sheet surface. This tension coating is generally a phosphate-colloidal silica based glass coating, yet an oxide having a low coefficient of thermal expansion such as an alumina borate based oxide, or carbide, nitride and the like which are coating yielding even higher tension is also effective. When applying tension coating, it is important to adjust the application amount, baking conditions and the like to sufficiently bring out the tension.

The grain-oriented electrical steel sheet described herein is obtained by subjecting the grain-oriented electrical steel sheet obtained through the above process to magnetic domain refining by introducing strains, and forming, as already described, the steel sheet shape of when the grain-oriented electrical steel sheet is placed on a flat surface into an appropriate shape.

Further, a transformer iron core using the above mentioned grain-oriented electrical steel sheet described herein can further reduce iron loss, and as a result, it can contribute to enhancing efficiency of the transformer.

EXAMPLES

A steel slab containing Si: 3.2 mass %, C: 0.07 mass %, Mn: 0.06 mass %, Ni: 0.05 mass %, Al: 0.027 mass %, N: 0.008 mass %, Se: 0.02 mass %, and the balance Fe with incidental impurities was heated to 1450° C. and hot rolled to 1.8 mm thick. Then, cold rolling was performed twice with intermediate annealing performed therebetween to obtain a cold rolled sheet for a grain-oriented electrical steel sheet with a final sheet thickness of 0.23 mm which in turn was subjected to primary recrystallization annealing combined with decarburization. Then, an annealing separator containing MgO as the main component was applied, and final annealing including a secondary recrystallization process and a purification process was performed to yield grain-oriented electrical steel sheets with a forsterite film. Then, the steel sheets were coated with insulating coating composed of 60% colloidal silica and aluminum phosphate so that the weight after drying is 5 g/m$^2$ per surface and baked at 800° C.

Here, as indices of magnetic properties, iron loss per 1 kg of a steel sheet when magnetized to 1.7 T in an alternating magnetic field with an excitation frequency of 50 Hz is $W_{17/50}$, and magnetic flux density at a magnetic field strength of 800 A/m is $B_8$. Iron loss $W_{17/50}$ and magnetic flux density $B_8$ of the above obtained steel sheet was measured in a single sheet tester, and the results thereof were 0.83 W/kg, 1.94 T respectively.

Steel sheets for iron core material subjected to magnetic domain refining were produced by linearly introducing strains in a direction orthogonal to the rolling direction of the steel sheet by further performing electron beam irradiation to the grain-oriented electrical steel sheets repeatedly with irradiation intervals of d (mm) in the rolling direction. Here, the electron beam irradiation conditions are as described in Table 1. Then, the obtained steel sheets were slit in 100 mm width, cut to have beveled edges to produce steel sheets which become iron core materials, and oil immersed transformers with a three-phase three-leg stacked iron core were produced as test transformers. The iron core has an outer diameter of 500 mm×500 mm, window of 100 mm×300 mm, lamination thickness of 100 mm, and the iron core weight is approximately 145 kg. The yokes and legs of the iron core were bound with a glass tape, and the iron core was flattened by pressing with a structural steel sheet having a thickness of 2 mm, and then the yokes were pressed against a jig and fastened with a bolt. The test transformers were excited with alternative current at a magnetic flux density of 1.7 T, frequency of 50 Hz, and no-load loss was measured as iron loss of the test transformers.

For each electron beam irradiation condition, the steel sheet shape was measured using a laser type shape measuring device. When measuring the steel sheet shape, steel strips with a width of 100 mm were cut into length of 100 mm, placed on a flat stage with the electron beam irradiated side used as the surface to be measured, and both ends of the steel sheet in the rolling direction were secured with a tape so that they are closely adhered to the stage. The surface profile was measured for 50 mm in the rolling direction using a laser type shape measuring system with the center position as the reference point. The maximum and minimum values of height from the stage were examined per every electron beam irradiation interval d (mm) to obtain the difference between the maximum value and the minimum value, and the mean value h (mm) of the difference in height over the entire length 50 mm was obtained. Further, using a single sheet tester, iron loss of the steel sheets for iron core material was measured.

For each sample transformer, iron loss, irradiation interval d, mean value h of difference in height, and the ratio h/d of h to d are shown in Table 1. Further, iron loss of the steel sheets used is also shown in the table.

TABLE 1

| | Electron Beam Irradiation Conditions | | | | Iron Loss | | | | | |
|---|---|---|---|---|---|---|---|---|---|---|
| No. | Beam Diameter (mm) | Scanning Rate (m/s) | Accelerating Voltage (kV) | Beam Current (mA) | Properties of Steel Sheet (W/kg) | d (mm) | h (mm) | h/d | Iron Loss of Transformer (W) | Remarks |
| 1 | 0.35 | 20 | 60 | 7 | 0.72 | 4 | 0.012 | 0.003 | 131 | Example |
| 2 | 0.35 | 20 | 60 | 11.5 | 0.72 | 4 | 0.050 | 0.0125 | 133 | Example |

TABLE 1-continued

| | Electron Beam Irradiation Conditions | | | | Iron Loss | | | | | |
|---|---|---|---|---|---|---|---|---|---|---|
| No. | Beam Diameter (mm) | Scanning Rate (m/s) | Accelerating Voltage (kV) | Beam Current (mA) | Properties of Steel Sheet (W/kg) | d (mm) | h (mm) | h/d | Iron Loss of Transformer (W) | Remarks |
| 3 | 0.35 | 20 | 60 | 10 | 0.73 | 5 | 0.030 | 0.006 | 133 | Example |
| 4 | 0.35 | 20 | 60 | 11 | 0.73 | 6 | 0.040 | 0.0067 | 133 | Example |
| 5 | 0.35 | 20 | 60 | 18 | 0.74 | 8 | 0.040 | 0.005 | 136 | Example |
| 6 | 0.35 | 20 | 60 | 8 | 0.73 | 3 | 0.010 | 0.0033 | 132 | Example |
| 7 | 0.35 | 20 | 60 | 5 | 0.74 | 4 | 0.007 | 0.0018 | 141 | Comparative Example |
| 8 | 0.35 | 20 | 60 | 16.5 | 0.74 | 4 | 0.065 | 0.0163 | 144 | Comparative Example |
| 9 | 0.35 | 20 | 60 | 20 | 0.74 | 8 | 0.135 | 0.0169 | 145 | Comparative Example |
| 10 | 0.35 | 20 | 60 | 6.5 | 0.74 | 4 | 0.010 | 0.0025 | 136 | Example |
| 11 | 0.35 | 20 | 60 | 6 | 0.74 | 4 | 0.009 | 0.0023 | 141 | Comparative Example |
| 12 | 0.35 | 20 | 60 | 14 | 0.74 | 4 | 0.060 | 0.015 | 137 | Example |
| 13 | 0.35 | 20 | 60 | 15 | 0.74 | 4 | 0.062 | 0.0155 | 146 | Comparative Example |
| 14 | 0.35 | 20 | 60 | 12 | 0.74 | 6.5 | 0.052 | 0.008 | 136 | Example |

From Table 1, it can be seen that even if iron loss of the material steel sheets are nearly the same, iron loss of the resulting sample transformers can be reduced when the ratio h/d of h to d is 0.0025 or more and 0.015 or less.

INDUSTRIAL APPLICABILITY

By forming a grain-oriented electrical steel sheet subjected to magnetic domain refining by introducing strains into an appropriate shape for being placed on a flat surface in accordance with the disclosure, iron loss of the resulting transformer can surely be reduced.

REFERENCE SIGNS LIST

1 Steel sheet
d Repeating interval of strains
h Mean value of difference in height

The invention claimed is:

1. A grain-oriented electrical steel sheet subjected to magnetic domain refining by introducing linear strains having a shape of a solid line in a direction intersecting a rolling direction of the steel sheet repeatedly at a predetermined interval in the rolling direction, wherein the predetermined interval of the linear strains in the rolling direction is d mm and, when the steel sheet is placed on a flat surface, a mean value of difference between a height from the flat surface to the linear strain-introduced area of a steel sheet surface and a height from the flat surface to a median point between adjacent linear strain-introduced areas is h mm, and a ratio h/d of the h to the d is 0.0025 or more and 0.015 or less.

2. The grain-oriented electrical steel sheet according to claim 1, wherein the d is 3 mm or more and 6 mm or less.

3. The grain-oriented electrical steel sheet according to claim 1, wherein the linear strain is formed by electron beam irradiation.

4. A transformer iron core using the grain-oriented electrical steel sheet according to claim 1.

5. The grain-oriented electrical steel sheet according to claim 2, wherein the linear strain is formed by electron beam irradiation.

6. A transformer iron core using the grain-oriented electrical steel sheet according to claim 2.

7. A transformer iron core using the grain-oriented electrical steel sheet according to claim 3.

8. A transformer iron core using the grain-oriented electrical steel sheet according to claim 5.

* * * * *